US005862563A

United States Patent [19]

Hartmann

[11] Patent Number: 5,862,563

[45] Date of Patent: Jan. 26, 1999

[54] SELF-CLEANING BRUSH

[76] Inventor: Eric Hartmann, 244, Chemin du Tour, Laval, Quebec, Canada, H7Y 1G9

[21] Appl. No.: 942,755

[22] Filed: Oct. 2, 1997

[51] Int. Cl.[6] ..... A46B 7/00; A46B 9/10; A46B 17/06

[52] U.S. Cl. ..... 15/169; 15/184; 15/246; 119/628; 132/119

[58] Field of Search ..... 15/169, 184, 185, 15/246; 132/119, 121, 123; 119/628, 629

[56] References Cited

U.S. PATENT DOCUMENTS

| | | | |
|---|---|---|---|
| 2,584,023 | 1/1952 | Johnson et al. | 132/123 |
| 4,214,340 | 7/1980 | Youngberg et al. | 15/184 |
| 4,412,365 | 11/1983 | Schmitt | 15/169 X |
| 4,574,416 | 3/1986 | Stewart et al. | 15/169 |
| 4,987,633 | 1/1991 | Heneveld | 15/169 X |
| 5,519,912 | 5/1996 | Kawamura | 15/169 X |

FOREIGN PATENT DOCUMENTS

| | | | |
|---|---|---|---|
| 2933200 | 3/1981 | Germany | 132/119 |
| 1587494 | 4/1981 | United Kingdom | 15/169 |
| 2243765 | 11/1991 | United Kingdom | 15/184 |

*Primary Examiner*—Mark Spisich

[57] ABSTRACT

A self-cleaning brush having a brush body with a pair of sides, a back and a top, a backing member mounted within the brush body, the backing member having an arcuate upper surface, a flexible membrane extending between the sides of the brush body, a plurality of bristles attached to the flexible membrane, a component to urge arcuate upper surface of the backing member into contact with the flexible membrane such that the bristles will assume a convex configuration extending from one of the sides to the other of the sides, and a cleaning plate adapted to lie in juxtaposition to the flexible membrane, the cleaning plate having apertures therein through which the bristles extend. The arrangement provides for a self-cleaning brush wherein the cleaning plate is retained in position by the bristles and permits one to have a convex brushing surface.

2 Claims, 3 Drawing Sheets

SELF-CLEANING BRUSH

The present invention relates to a brush and more particularly, to a self-cleaning brush.

Self-cleaning brushes are well known in the art and there have been many proposals for such brushes. Generally, a self cleaning brush is one in where the bristles of the brush can be retracted through apertures formed in an exterior wall of the brush to remove any material thereon such as hair and the like. At the same time, the bristles are held in a normal position for normal brushing purposes.

A number of different structures have been proposed in the art for removing foreign materials from bristles. Generally, these arrangements utilize a mobile cleaning plate permitting movement relative thereof to the brush body. However, the structure of such self-cleaning brushes has generally been limited to those wherein the bristles emerge from a backing member perpendicular to—i.e. the bristles are all parallel and of a substantially uniform length.

Many people prefer the use of brushes which have angled bristles to create an arcuate or somewhat rounded bushing surface. Indeed, most regular brushes tend to have this configuration as the arcuate surface allows the brush to be more effective and comfortable for brushing purposes. However, the prior art is silent with respect to such a structure incorporating a cleaning plate.

It is an object of the present invention to provide a self cleaning brush wherein the bristles are angled.

It is a further object of the present invention to provide a self cleaning brush having angled bristles wherein a cleaning plate allows removal of foreign matter from the bristles.

According to one aspect of the present invention, in a self-cleaning brush which has a brush body with a pair of sides, a back and a top with bristles extending therefrom, the bristles being designed to assume a convex configuration extending from one of the sides to the other of the sides, and a cleaning plate having apertures with the bristles extending therethrough, there is provided the improvement which comprises a flexible membrane having the bristles attached thereto, the flexible membrane being attached to the side, and a backing member having a convex upper surface adapted to contact the flexible membrane, and means for moving the backing member between retracted and extended positions.

In a further aspect of the present invention, there is provided a self-cleaning brush comprising a brush body having a pair of sides, a back, and a top, a backing member having a convex upper surface mounted within the brush body, a flexible membrane attached to the sides of the brush body, a plurality of bristles attached to the flexible membrane, means for urging the backing member against the flexible membrane and the convex upper surface whereby the bristles will assume a convex configuration extending from one of the sides to the other of the sides, and a cleaning plate adapted to lie in juxtaposition to the flexible membrane, the cleaning plate having apertures therein through which the bristles pass.

In greater detail, the present invention permits one to use a self-cleaning brush wherein the bristles do not have to be perpendicular to the base of the brush. Rather, one can use a rounded brushing surface which is more effective and comfortable for brushing purposes.

The self-cleaning brush of the present invention can be easily manufactured out of conventional materials. Thus, one can use suitable plastic components with the flexible membrane preferably being of a rubber or rubber like material.

Having thus generally described the invention, reference will be made to the accompanying drawings illustrating an embodiment thereof, in which.

Figure 11:
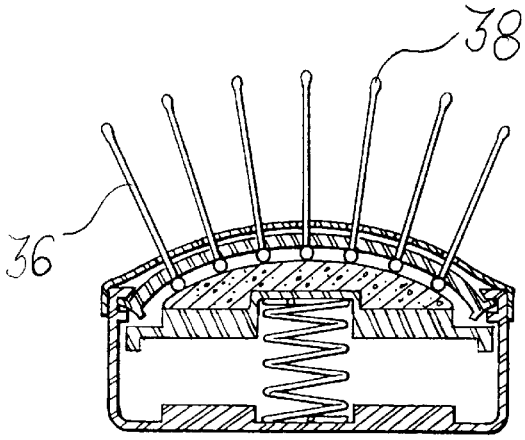
Figure 12:
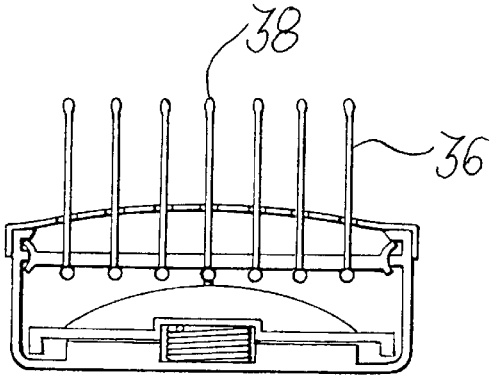

FIG. 11, in a cross-sectional view, illustrates the self-cleaning brush with its brisles in a fanned configuration;

FIG. 12, in a cross-sectional view, illustrates the self-cleaning brush with its brisles In a parallel relationship to each other.

Referring to the drawings in greater detail and by reference characters thereto, there is illustrated in FIGS. 1 to 10 a first embodiment of a self cleaning brush and which brush is generally designated by reference numeral 10.

Self cleaning brush 10, as is conventional, includes a body 12 and a handle 14. Handle 14 has a handle back wall 16 and a handle top wall 18. Body 12 similarly includes a body back wall 20 and has a pair of body side walls 22 and 24 extending upwardly therefrom.

Mounted interiorly of body 12 and handle 14 is a longitudinally extending support member 26. Support member 26 is mounted substantially parallel to handle back wall 16 and body back wall 20 but is spaced therefrom by stop elements 28. A plurality of springs 30 are mounted between support member 26 and body back wall 20 and handle back wall 16 to urge support member 26 outwardly from back walls 20 and 16.

A push button or activating element 32 is connected to support member 26 and extends through an aperture in handle top wall 18.

In the illustrated embodiment, the self cleaning brush includes a plurality of bristles 36 of the type which have a comfort tip 38 mounted at the distal end thereof. Bristles 36 are connected to a flexible membrane 40.

Mounted intermediate an upper surface of support member 26 and flexible membrane 40 is a backing member 42 which as may be seen in the Figures, has an arcuate convex upper surface 44. At the vertex 46 of arcuate upper surface 44, backing member 42 is attached to flexible membrane 40.

Flexible membrane 40 is in turn attached to body side walls 22 and 24 by membrane connecting segments 48 and 49 respectively. As may be best seen in FIG. 4, support member 26 includes a guiding element 50 extending along a side peripheral edge thereof to ensure proper movement thereof as will be discussed in greater detail hereinbelow.

Figure 6:
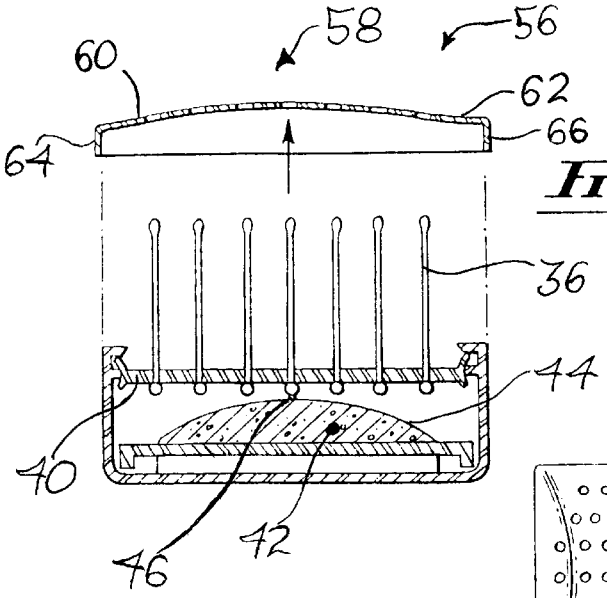
FIG. 6 is a cross sectional view showing removal of the cleaning plate.
Figure 7:
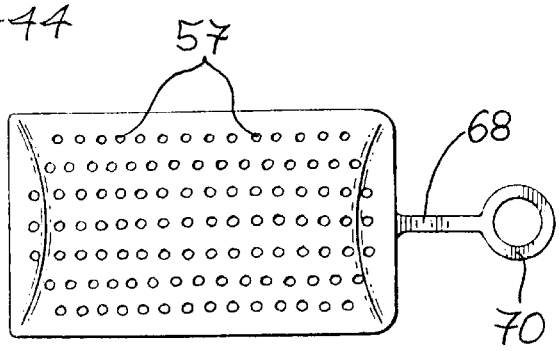
FIG. 7 is a plan view of the cleaning plate.
Figure 8:
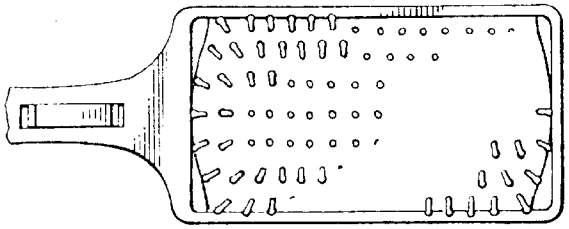
FIG. 8 is a plan view of the brush with its cleaning plate removed.
Figure 9:
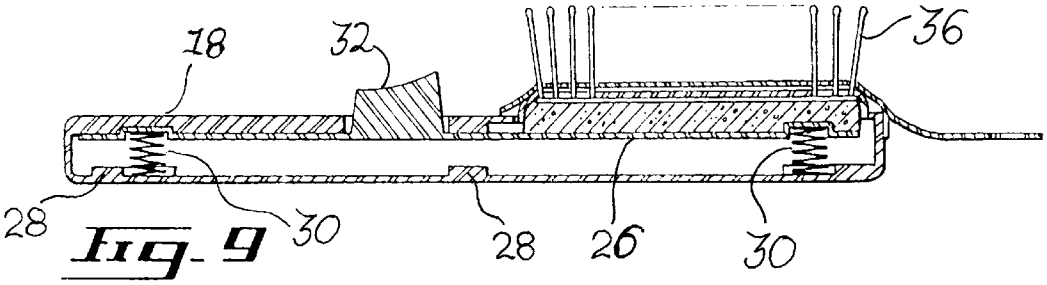
FIG. 9 is a longitudinal cross sectional view of the brush with the bristles in their normal extended brushing position.
Figure 10:
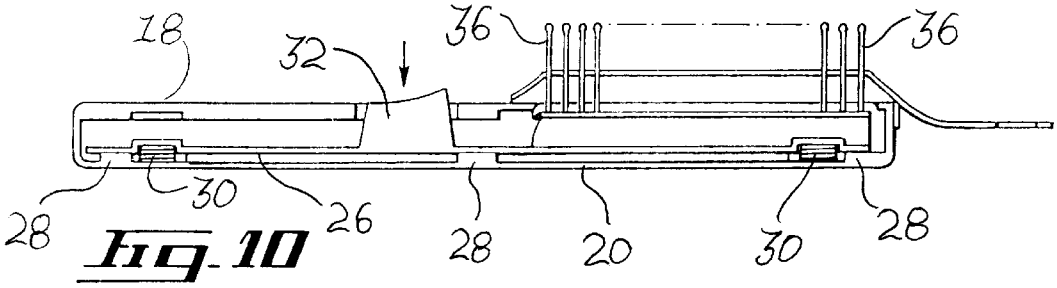
FIG. 10 is a longitudinal cross sectional view similar to FIG. 9 showing the bristles in a retracted position.

The invention includes a cleaning plate 56 which, as may be seen in profile in FIG. 6, has an arcuate central portion 58 which, at either side, extends outwardly in flat outer portions 60 and 62. In turn, a pair of downwardly extending flanges 64 and 66 are formed integrally from flat outer portion 60 and 62 respectively.

In operation, springs 30 normally exert a sufficient force to urge support member 26 upwardly whereby backing member 42 forces flexible membrane 40 to assume the configuration of arcuate upper surface 44 such that bristles 36 fan outwardly in a rounded arcuate configuration. The brush is then in its normal position for brushing.

When it is desired to clean the brush, pressure on push button or activating element 32 will overcome the pressure exerted by springs 30 and force support member 26 downwardly to rest against stop elements 28. This will also cause backing member 42 to withdraw into the housing of the brush and due to the attachment of flexible membrane 40 to vertex 46, bristles 36 will also be withdrawn through the apertures 57 in cleaning plate 56.

Cleaning plate 56 may be removed using cord 68 and finger engaging tab 70 for further cleaning if desired. When replaced on the bristles, and when the pressure on push button or activating element 32 is released, springs 30 will exert an upward pressure on support member 26, backing member 42 and flexible membrane 40. As a result, bristles 36 will extend in their arcuate configuration. It will be noted that this action will cause pressure on the sides of the apertures of cleaning plate 56 to retain it in position.

It will be understood that the above described embodiments are for purposes of illustration only and that changes and modifications may be made thereto without departing from the spirit and scope of the invention.

Figure 1:
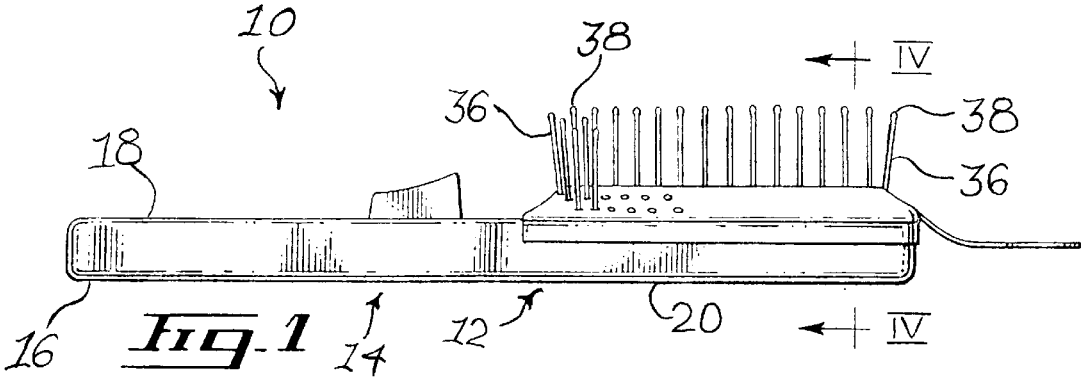
FIG. 1 is a side view of one embodiment of a self-cleaning brush according to the present invention.
Figure 2:
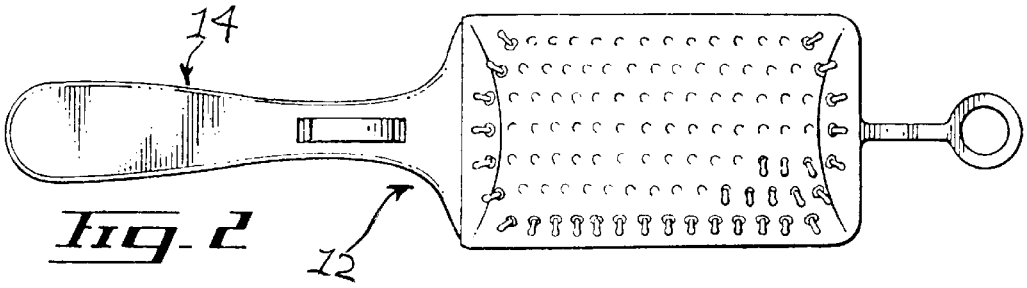
FIG. 2 is a front plan view thereof.
Figure 3:
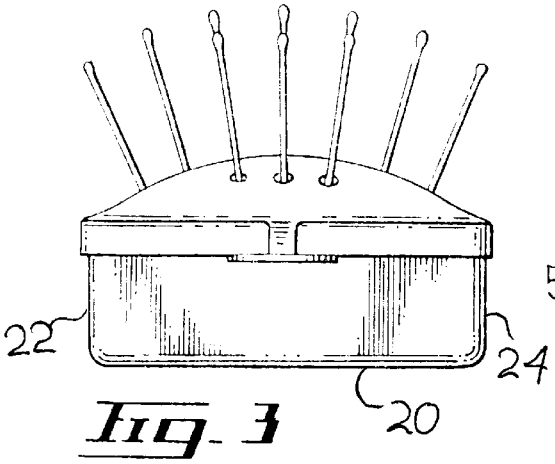
FIG. 3 is an end view thereof as seen from the right hand side of FIG. 2.
Figure 4:
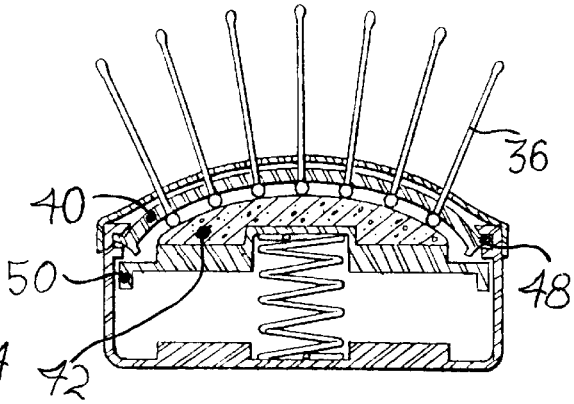
FIG. 4 is a cross sectional view taken along the lines 4—4 of FIG. 2.
Figure 5:
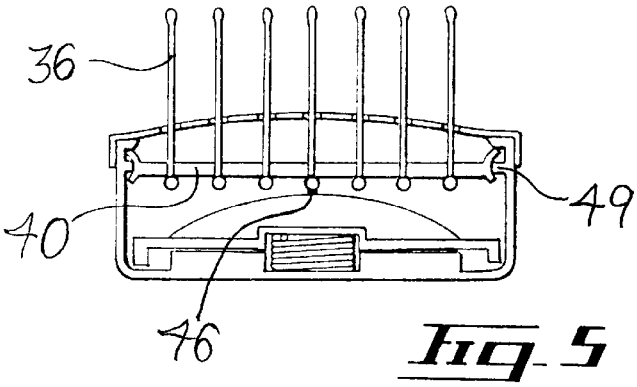
FIG. 5 is a cross sectional view similar to FIG. 4 illustrating retraction of the bristles.

One of the main features of the invention is that the use of a flexible membrane 40 allows for the bristles to assume a generally radial relationship relative to each other when the backing member 42 is in the position illustrated in FIG. 4. The flexible membrane 40 also allows the bristles to assume a generally parallel relationship to each other when the backing member 42 is in the position illustrated in FIG. 5.

The bristles may thus offer a rounded contour when the brush is being used and, yet, they may be readily and easily aligned for removing debris therefrom when needed.

I claim:

1. A self-cleaning brush comprising:

(a) an elongated brush body having a top, a bottom and a pair of sides extending therealong;

(b) a flexible member having opposite first and second surfaces wherein a plurality of bristles extending from the first surface thereof, said flexible member being secured at opposed edges thereof to the sides of the brush body, said flexible member being located adjacent the top of the brush body;

(c) a backing member having a convex upper surface, said backing member being attached to the second surface to the flexible member at a vertex of the convex upper surface, the backing member being adapted for movement relative to the top and bottom of the brush body between a retracted position and an extended position whereby the convex upper surface abuts the second surface of the flexible member and causes the flexible member to assume a convex shape;

(d) a support member disposed within said brush body between the backing member and the bottom of the brush body, the support member being movable and wherein movement of the support member causes the backing member to be moved between the retracted and extended positions; and (e) a cleaning plate removably attached to the brush body adjacent the top thereof, the cleaning plate having a plurality of apertures therein for receiving respective ones of the bristles.

2. A self-cleaning brush as recited in claim 1, wherein said bristles have a slightly enlarged comfort tip at their distal end.

* * * * *